US005447758A

United States Patent [19]

Pelletier

[11] Patent Number: 5,447,758

[45] Date of Patent: Sep. 5, 1995

[54] PVC SHEET SCREEN PRINTING PROCESS

[76] Inventor: Andrée Pelletier, 14255 Gouin West, Apt. 617, Pierrefonds, Québec, Canada, H8Z 3C2

[21] Appl. No.: 136,942

[22] Filed: Oct. 18, 1993

[51] Int. Cl.[6] ..... B05D 3/02; B05D 3/06; B05D 3/10; B41M 1/12

[52] U.S. Cl. ..... 427/511; 427/296; 427/316; 427/322; 427/393.5; 101/129

[58] Field of Search ..... 427/316, 296, 322, 282, 427/511, 393.5; 101/129

[56] References Cited

U.S. PATENT DOCUMENTS

| | | | |
|---|---|---|---|
| 3,317,339 | 5/1967 | Fortner et al. | 427/322 |
| 3,755,890 | 9/1973 | Klehm, Jr. | 427/296 |
| 3,928,664 | 12/1975 | Tarney et al. | 427/322 |
| 3,959,567 | 5/1976 | Bradley | 428/461 |
| 4,270,985 | 6/1981 | Lipson et al. | 427/511 |
| 4,521,458 | 6/1985 | Nelson | 427/296 |
| 4,547,406 | 10/1985 | Armstrong | 427/282 |
| 4,822,451 | 4/1989 | Ouderkirk et al. | 427/322 |
| 4,973,992 | 11/1990 | Owatari | 346/140 R |
| 5,118,532 | 6/1992 | Batson et al. | 427/316 |
| 5,174,204 | 12/1992 | Meier et al. | 427/282 |

*Primary Examiner*—Diana Dudash
*Attorney, Agent, or Firm*—Pierre Lespérance; François Martineau

[57] ABSTRACT

A screen printing process for providing long-lasting, visually-appealing images on PVC sheet material such PVC venetian blind slats, through use of a computer hardware and CAD/CAM and computer color-matching software. The process, which is for ink-printing the outer surface of a siliconeless PVC sheet (preferably a blind slat) inside a work room, comprises the following steps: (a) purging the atmosphere of the work room from substantially all airborne silicone particles and maintaining the purged atmosphere at a positive pressure relative to air pressure; (b) heating the slat for a duration and at a temperature level sufficient to fully ink prime the slat outer surface; (c) oxydizing the primed slat outer surface; (d) screen coating the slat outer surface with an ink, this ink being of the type curable under the action of an ultra-violet radiation; and (e) curing the ink-coated slat by submitting the latter to an electromagnetic radiation at a radiation intensity and duration sufficient to completely set the ink onto the slat outer surface; wherein the ink-coated slat outer surface becomes highly scratch-resistant.

1 Claim, No Drawings

PVC SHEET SCREEN PRINTING PROCESS

FIELD OF THE INVENTION

This invention relates to the field of screen printing, particularly to the ink printing on PVC sheets such as PVC venetian blind slats.

BACKGROUND OF THE INVENTION

Current state of the art computerized CAD/CAM systems enable an artist to scan existing original drawing with a scanning unit, then edit this original drawing with a computer displaying the scanned original drawing onto a computer video monitor, and then to print the edited drawing onto a variety of substrates including paper sheets, vinyl panels, plywoods, foamboards, plexiglass, metals and the like. More particularly, the artist is able to operate the computer keyboard to negotiate with a user friendly menu-driven application software, to edit the drawing. Such application software includes advanced editing features, such as zoom and pan, auto-kerned fonts with line, arc true spline curve and other functions, copy and move with animated graphics, animated spin-rotation for text and/or graphics, symmetrical image reproduction across any imaging line, 3-D perspectives with user-specified vanishing points and viewing angles. Moreover, these application softwares may provide graphic operations color selection, whereby the computer system will automatically output the print-out with the color selected by the artist from the various color layouts appearing on the computer video monitor. See for example the computerized, combined hardware and software unit called Ana Design Station (a trademark), manufactured by Anagraph, inc. of Costa Mesa, Calif.

For printing these drawings, so-called screen printing and curing systems are used. The usual printing system will be the silk screen process: namely, a technique of printing in which a sheet of silk, stretched tightly over a frame, is painted with a resist or is partially covered with a waxy stencil to block out areas of a design, so that when the screen is lowered onto the paper or textile to be printed, ink may be forced by squeegee through the unobstructed areas. The ink curing system is radiation-borne, either in the Ultra-Violet, visible, or Infra-Red electromagnetic radiation spectrum range, so that the radiation-sensitive ink will fuse with the underlying substrate as it is radiation-cured.

Most of the blind slats commercially sold in America are made from a cheap plastic material known as PVC, i.e. PolyVinyl Chloride. It is of course aesthetically desirable to match the colour of these PVC blind slats with those of the floor covering, wall paint and furnitures in the room where the blind is to be applied against a corresponding window. Most of the PVC blind slats are therefore colored accordingly.

Usually, the blind slat color will be uniform, i.e., all white, or yellow, or another color. PVC slats may be colored in such a way as to provide a special, visually-appealing pattern. Unfortunately, because the commercially available PVC slats are conventionally coated with a silicone compound (as an anti-static measure), such printed image patterns on the slats will be easily scratched and will accordingly lose their visual appeal.

More particularly, current methods for ink-printing venetian blinds or vertical blinds, which consist of slats (generally rectangular, thin panels), are as follows:

(a) by the paper transfer technique

In this technique, a heat-sensitive film melts and fuses with the blind. Such film usually contains silicone, as an anti-static agent. Because of the presence of silicone, the film will eventually wither under scratching action.

(b) by the hair-brush technique

The technique of simply painting the slat directly with a paint brush, directly by the artist. A major drawback of such a technique is the fact that, again, it will mar easily.

(c) by the groover technique

In this technique, fabric or paper sheets are inserted into the grooves of the blade, to provide a room matching color different from that of the slat itself (since the slat is thus concealed by the fabric or paper sheet, the color of the slat does not matter).

OBJECT OF THE INVENTION

The gist of the invention is therefore to address the need to provide long-lasting, visually-appealing, image pattern drawings on PVC sheet material such as PVC blind slats, which will be highly scratch-resistant.

DETAILED DESCRIPTION OF THE INVENTION

Accordingly with the object of the invention, there is disclosed a process for ink-printing a PVC sheet material (preferably being a blind slat) inside a work room. This process, which is for ink-printing an outer surface of a siliconeless PVC sheet material (preferably a blind slat) inside a work room, comprises the following steps: (a) purging the atmosphere of said work room from all airborne silicone particles to form a purged atmosphere; (b) maintaining said purged atmosphere at a positive air pressure relative to atmospheric air pressure; (c) heating said sheet material for a duration and at a temperature level sufficient to fully ink prime said sheet material outer surface; (d) oxydizing said primed sheet material outer surface; (e) screen coating said sheet material outer surface with an ink which is curable under the action of ultra-violet radiation; and (f) curing said ink-coated sheet material by submitting the latter to an said ultra-violet radiation at a radiation intensity and duration sufficient to completely cure the ink onto said sheet material outer surface; wherein said ink-coated sheet material outer surface becomes highly scratch-resistant.

Profitably, said oxydizing of the surface of the sheet material is made through operation of an ozone neutralizer.

It is envisioned that ink screen coating of said sheet material be effected with a polyester fabric sheet, or most preferably with the silk screen method, and would last for approximately one minute or less. Preferably then, there would be further included the additional steps of creating CAD/CAM-generated images (most preferably being in color) and print-reproducing said images onto said sheet material outer surface during said ink screen coating step.

The type of ink to print the PVC sheet material such as PVC blind slats, according to the present invention, must be of a type which: is UV curable as mentioned above; is formulated for reliable adhesion to a wide variety of substrates (e.g. paper, board, polystyrene, top-coated polyester, polyethelene, but preferably particularly PVC); has excellent cure speed and appearance; and boasts a high degree of protection from scuffing and marring.

Such a UV-curable ink may be e.g. the one manufactured under the trademark HUG screen printing ink, from the Advance Excello Color group of Chicago, Ill.; or from the series 100 UV-curable, Kolorcure ink products, manufactured by Pantone, Inc., of Batavia, Ill.

The UV-curable ink is preferably cure-dryed using at least one 200-watt mercury vapor lamp, for a duration of only a few seconds at the most (these inks will not air-dry). Moreover, the duration and temperature levels of ink-priming heating may be as follows: a few minutes, in the 100° to 150° C. range.

In the color printing process, the oxydation is preferably done through use of a commercially available (so-called) ozone neutralizer. This ozone neutralizer removes ozone (i.e., $O_3$) from the station.

The so-called purging of the atmosphere of the work room from airborne silicone particles, is effected simply by providing a very clean, dustfree workplace. To ensure such a controlled environment, positive air pressure is maintained in the work room, whereby external contaminants will be precluded from unauthorized room ingress.

With the above described process, a blind slat can be obtained which will possess a long-lasting, scratch-resistance, and a black and white or colored image pattern. This pattern, generated by CAD/CAM technology, may be of any type, the limit of the pattern being that of the artist's imagination. For example, surrealist-type painting images may be created by the artist, aided for example simply by hand painting; or alternately by computer-assisted tools, captured, and then ink-printed onto the PVC slat.

I claim:

1. A process for ink-printing an outer surface of a siliconeless, polyvinyl chloride sheet material inside a work room, comprising the following steps:

(a) purging the atmosphere of said work room from all airborne silicone particles to form a purged atmosphere;

(b) maintaining said purged atmosphere at a positive air pressure relative to atmospheric air pressure;

(c) heating said sheet material for a duration and at a temperature level sufficient to fully ink prime an outer surface of said sheet material;

(d) oxydizing said primed sheet material outer surface;

(e) screen coating said sheet material outer surface with an ink which is curable under the action of ultra-violet radiation; and (f) curing said ink-coated sheet material by submitting said sheet material to said ultra-violet radiation at a radiation intensity and duration sufficient to completely cure the ink onto said sheet material outer surface;

whereby said ink-coated sheet material outer surface becomes scratch-resistant.

* * * * *